US006241647B1

(12) United States Patent
Peng

(10) Patent No.: US 6,241,647 B1
(45) Date of Patent: Jun. 5, 2001

(54) EMI SHIELD PLUG

(75) Inventor: Yao-Che Peng, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/595,845

(22) Filed: Jun. 16, 2000

(30) Foreign Application Priority Data

Jun. 22, 1999 (TW) ..... 88210240

(51) Int. Cl.[7] ..... H01R 4/66; H01R 13/648

(52) U.S. Cl. ..... 493/95; 439/92

(58) Field of Search ..... 439/92, 95, 96, 439/101, 108; 361/424, 758, 799, 800, 801; 174/51, 138 G

(56) References Cited

U.S. PATENT DOCUMENTS 3,109,689 * 11/1963 Cooney ..... 439/329
4,938,703 * 7/1990 Nakano ..... 439/74
5,138,529 * 8/1992 Colton et al. ..... 361/816
5,218,760 * 6/1993 Colton et al. ..... 29/845
5,313,016 * 5/1994 Brusati et al. ..... 174/35 GC
5,435,750 * 7/1995 Kosmala ..... 439/567
5,934,916 * 8/1999 Latal et al. ..... 439/95
5,984,697 * 11/1999 Moran et al. ..... 439/92

* cited by examiner

*Primary Examiner*—Kheim Nguyen
*Assistant Examiner*—Chandrika Prasad
(74) *Attorney, Agent, or Firm*—Wei Te Chung

(57) ABSTRACT

An EMI shield plug (1) includes an insulative body (10) and a metal plate (11). The body includes a base (100) and a post (109) downwardly projecting from the base (100). A pair of retention sections (104) is formed on opposite sides of the base. Each retention section defines an elongate tunnel (105) therethrough. The post includes a narrow neck (107) and a wide locking section (108) formed at a distal end of the neck (107). An elongate channel (106) is defined along a longitudinal axis of the post (109) thereby providing the post with resiliency. The metal plate (11) is unitarily stamped to form an arcuate contact section (110) and a pair of arms (112) on opposite ends of the contact section (110). In assembly, the arms (112) are inserted into the tunnels (105) of the body and each distal end thereof is inwardly bent to form an engaging section (114) attached to a bottom surface of the base (100).

15 Claims, 8 Drawing Sheets

EMI SHIELD PLUG

BACKGROUND OF THE INVENTION

1. Field of the Invention

The present invention generally relates to an EMI (Electromagnetic Interference) shield plug, and particularly to an EMI shield plug for efficiently engaging a PCB (Printed Circuit Board) and an enclosure for grounding purpose.

2. Description of the Prior Art

To ensure proper functioning in an environment having a high concentration of electromagnetic signals, a computer or a peripheral device usually has grounding and shielding means for eliminating the adverse effects of EMI. An electrical component mounted on a PCB is electrically connected to a grounding path of the PCB. The grounding path on the PCB is connected to a metal enclosure to form a full circuit path for eliminating electrical charges. Pertinent examples are disclosed in U.S. Pat. Nos. 5,608,611 and 5,620,290.

Referring to FIG. 1, conventional grounding means includes a hole 60 defined in a PCB 6, a screw 8, a conductive gasket 9, and an aperture 71 defined in a metal enclosure 7. A conductive pad 61 is disposed proximate the hole 60 of the PCB 6 for electrically engaging with the gasket 9. The gasket 9 defines a petaloid opening 91. In assembly, the screw 8 extends through the aperture 71, the opening 91 and the hole 60 to secure the enclosure 7, the gasket 9 and the PCB 6 together. Thus, the pad 61 is electrically connected to the enclosure 7 for grounding purposes. However, screw threads of the screw 8 are manufactured using a turner. Such a manufacturing process is time and cost inefficient.

SUMMARY OF THE INVENTION

Accordingly, a first object of the present invention is to provide an EMI shield plug having a time and cost efficient manufacturing process.

A second object of the present invention is to provide an EMI shield plug which is easily assembled.

To fulfill the above-mentioned objects, an EMI shield plug in accordance with the present invention comprises an insulative body and a metal plate. The body includes a base and a post projecting from a bottom surface of the base. The base defines a groove exposed to a top surface thereof. A pair of retention sections is formed on opposite sides of the base. Each retention section defines an elongate tunnel therethrough. The post includes a narrow neck and a wide locking section formed at a distal end of the neck. An elongate channel is defined along a longitudinal axis of the post thereby providing the post with resiliency. The metal plate is unitarily stamped to form an arcuate contact section and a pair of arms at opposite ends of the contact section. In assembly, the arms are inserted into the tunnels of the body, and each distal end thereof is inwardly bent to form an engaging section attached to a bottom surface of the base. The post is inserted into a corresponding hole in a PCB with the neck received in the hole and the locking section fixedly locking the PCB. The engaging sections of the metal plate engage with a pad proximate the hole on the PCB. The contact section of the metal plate is adapted to engage with a conductive enclosure for grounding purpose.

DETAILED DESCRIPTION OF THE PRESENT INVENTION

Figure 2:
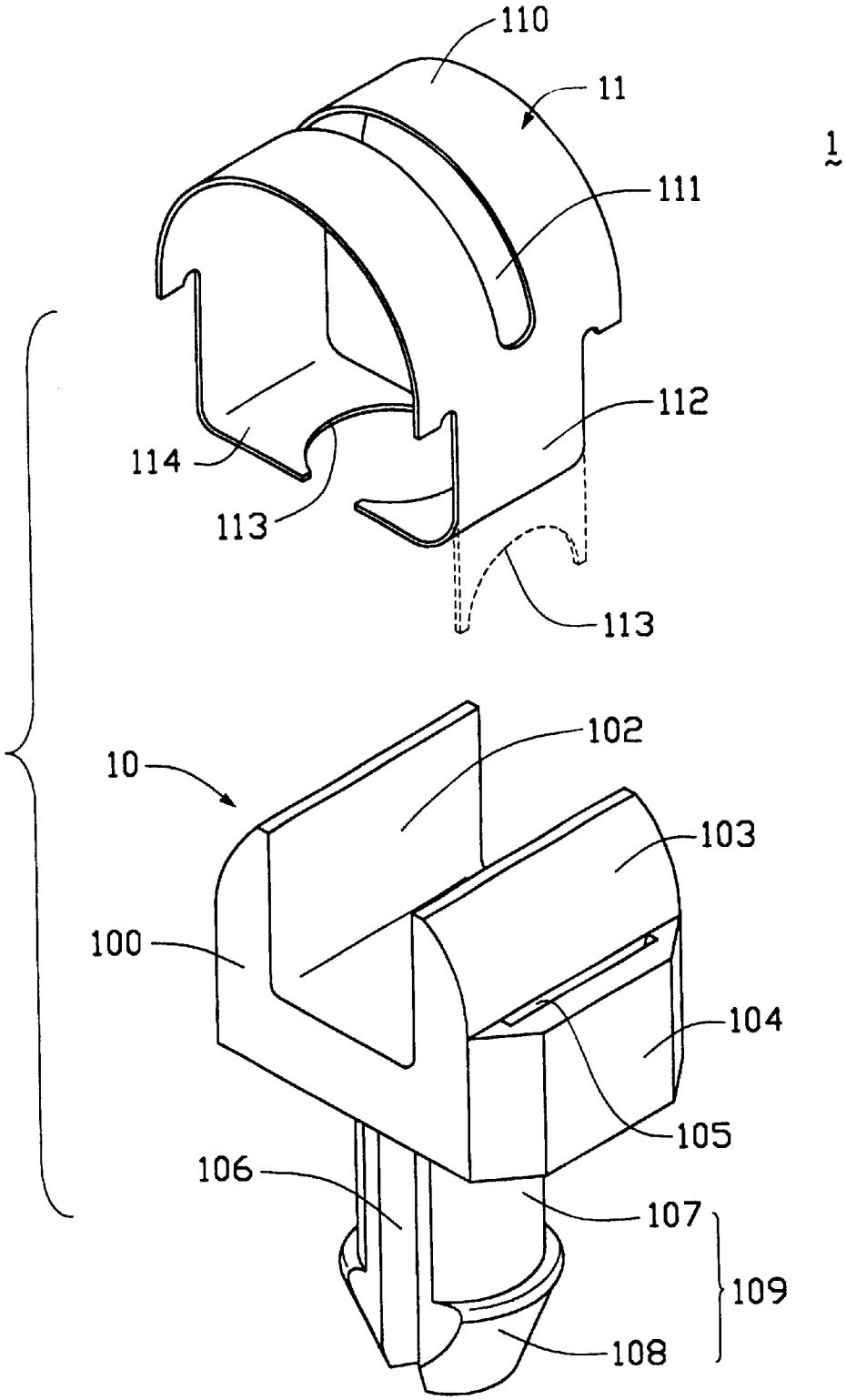
FIG. 2 is an exploded view of an EMI shield plug in accordance with a first embodiment of the present invention.
Figure 3:
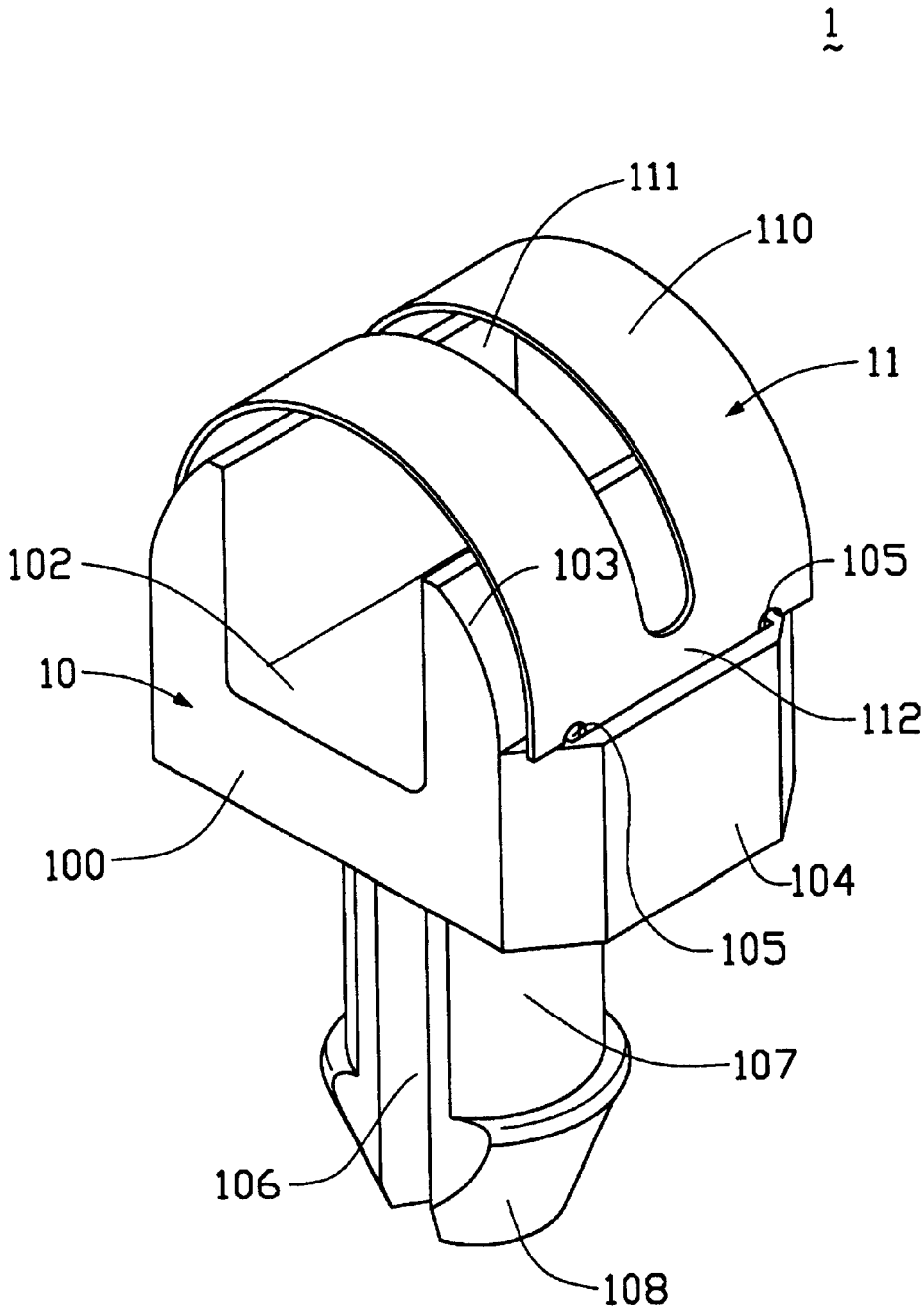
FIG. 3 is an assembled view of FIG. 2.

Referring to FIGS. 2 and 3, an EMI shield plug 1 in accordance with a first embodiment of the present invention comprises an insulative body 10 and a metal plate 11. The body 10 includes a base 100 and a post 109 projecting from a bottom surface of the base 100. The base 100 has an arcuate top surface 103 and defines a groove 102 exposed to the top surface 103. A pair of retention sections 104 is formed on opposite sides of the base 100. Each retention section 104 defines an elongate tunnel 105 therethrough. The post 109 includes a narrow neck 107 and a wide locking section 108 formed at a distal end of the neck 107. The locking section 108 forms an inclined surface (not labeled). An elongate channel 106 is defined along a longitudinal axis of the post 109 to provide the post 109 with resiliency.

The metal plate 11 is unitarily stamped to form an arcuate contact section 110 and a pair of arms 112 at opposite ends of the contact section 110. An elongate slot 111 is defined in the contact section 110 to provide the contact section 110 with resiliency.

Figure 1:
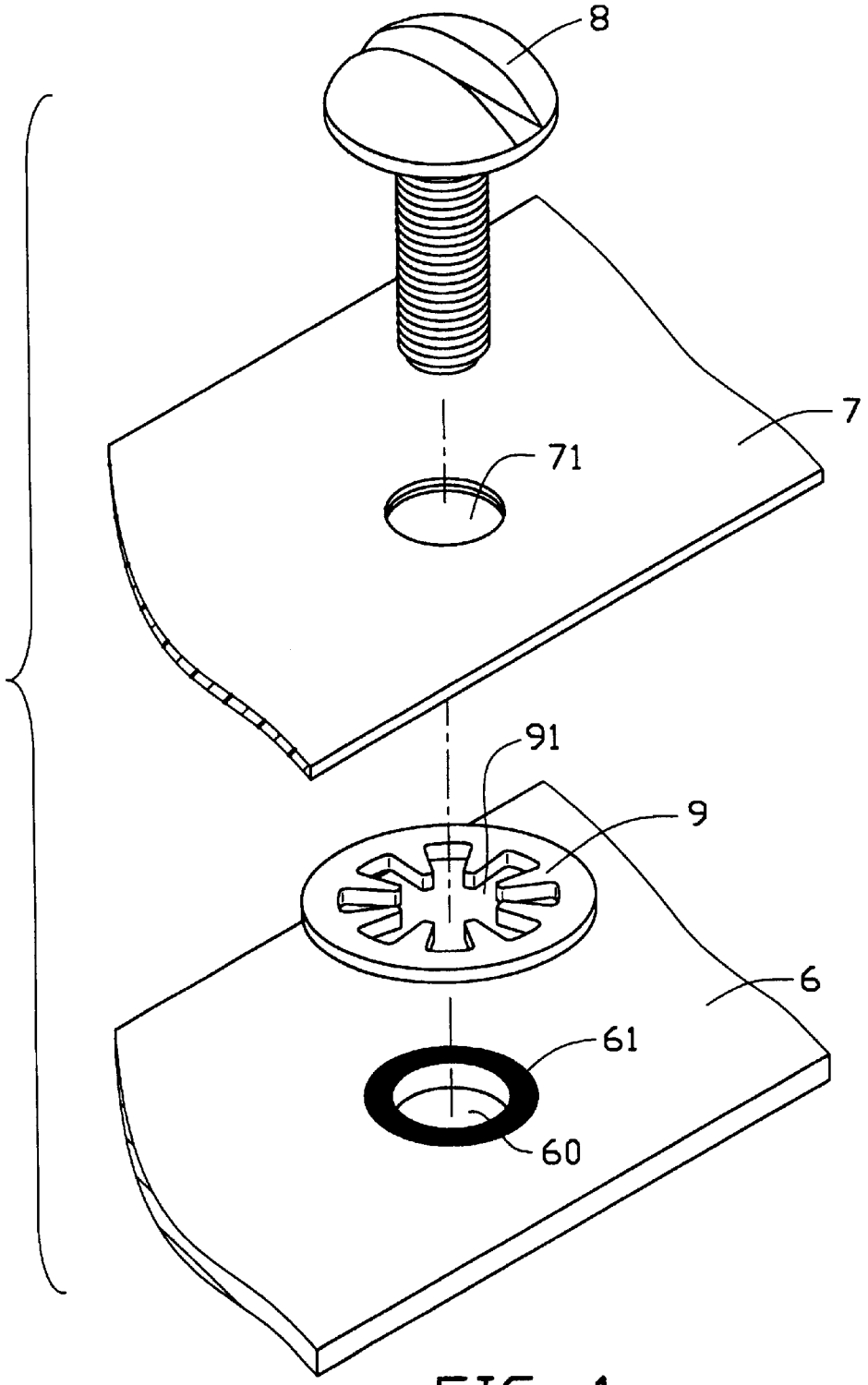
FIG. 1 (PRIOR ART)
FIG. 1 is an exploded view of a conventional means of grounding a PCB to a metal enclosure.
Figure 4:
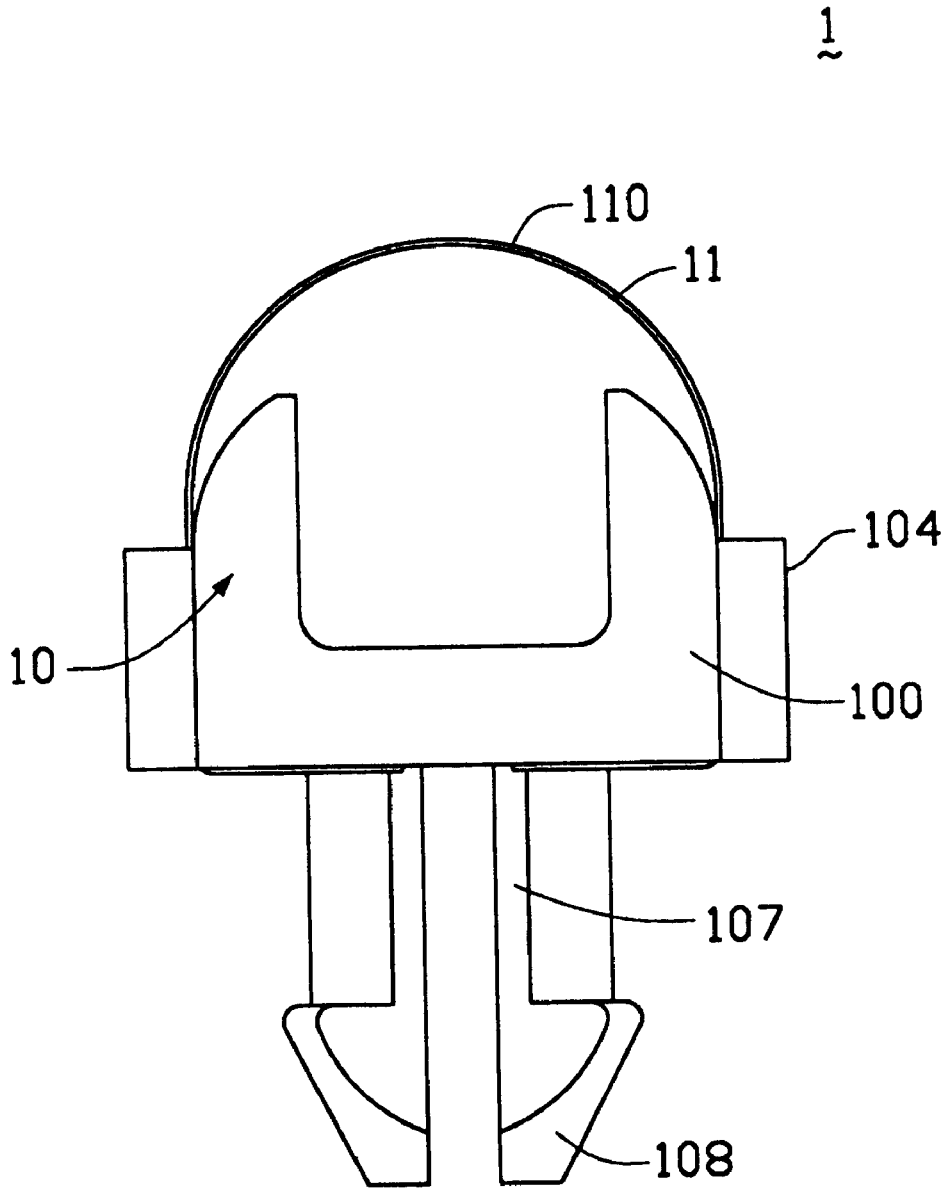
FIG. 4 is a side view of FIG. 3.
Figure 5:
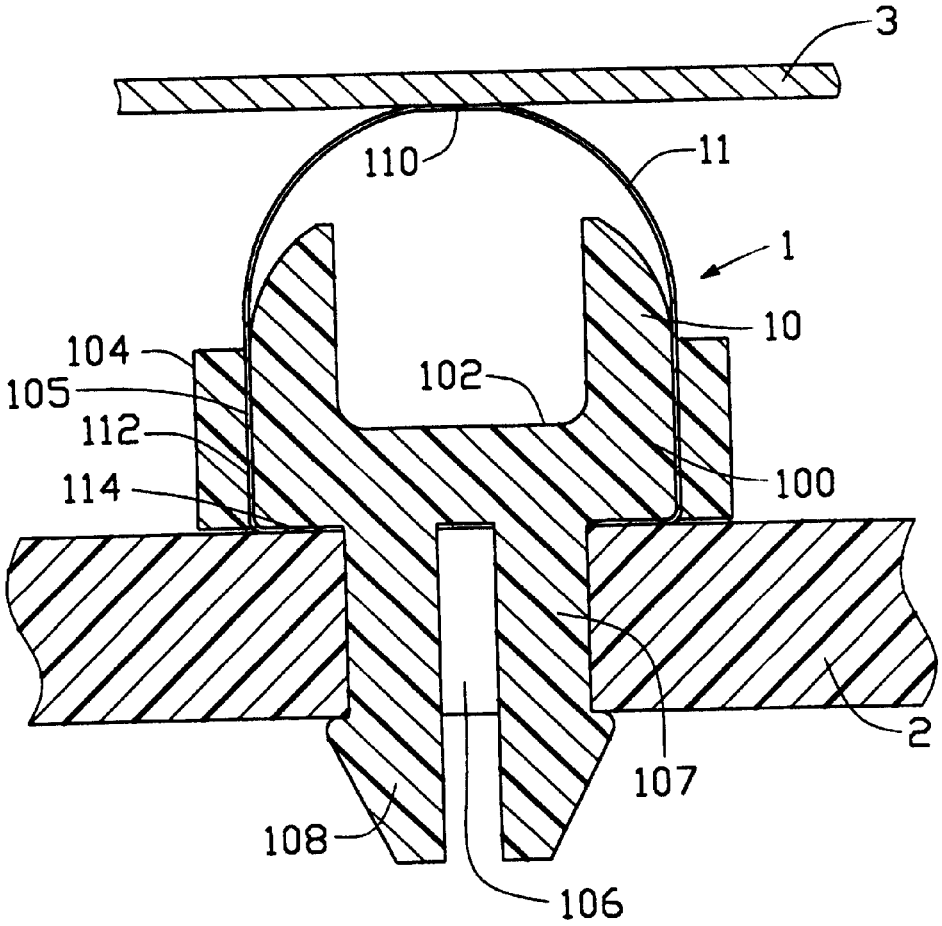
FIG. 5 is a cross-sectional view of the EMI shield plug of the present invention and a metal enclosure and a PCB to which the EMI shield plug is electrically connected.

Also referring to FIGS. 4 and 5, in assembly, the arms 112 are inserted into the corresponding tunnels 105 of the body 10 and then the distal end of each arm 12 is inwardly bent to form an engaging section 114 abutting against a bottom surface (not labeled) of the base 100. Each engaging section 114 forms an arcuate cutout 113 to accommodate the post 109. The post 109 is inserted into a corresponding hole (not labeled) in a PCB 2 with the neck 107 being received in the hole and the locking section 108 fixedly engaging the PCB 2 due to the resiliency provided by the channel 106 of the post 109. The PCB 2 is sandwiched between the base 100 and the locking section 108. The engaging sections 114 of the metal plate 11 engage with a pad (not shown while being able to refer to FIG. 1) proximate the hole on the PCB 2. The contact section 110 of the metal plate 11 is adapted to engage with a conductive enclosure 3 for grounding purposes. Thus, the pad on the PCB 2 is electrically connected to the conductive enclosure 3 to form a circuit path for electrostatic discharge.

Such an EMI shield plug 1 has a simple structure and can be easily assembled thereby promoting a time and cost efficient manufacture thereof. In addition, the EMI shield plug 1 is easily assembled to the PCB 2 by the process described above.

Figure 6:
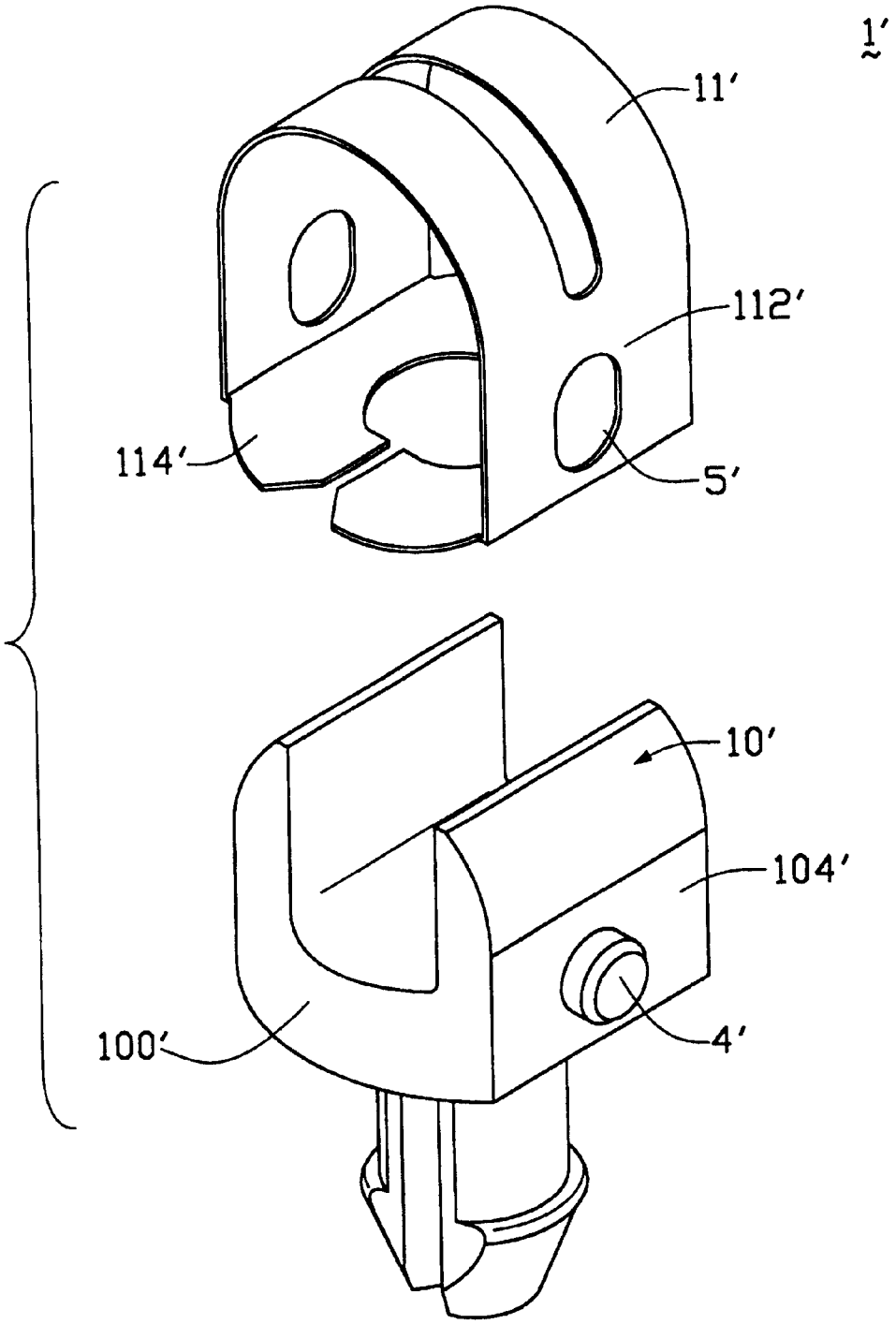
FIG. 6 is an exploded view of an EMI shield plug in accordance with a second embodiment of the present invention.
Figure 7:
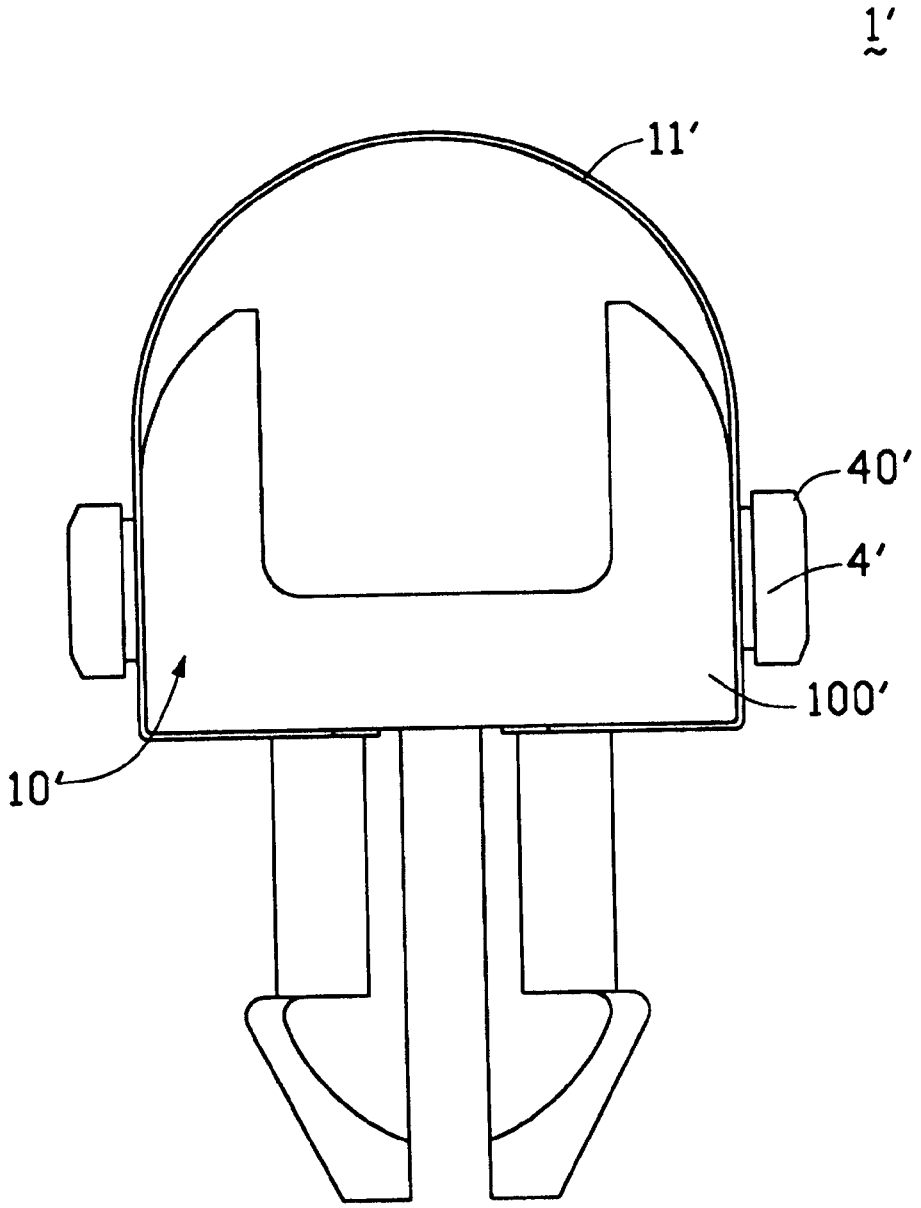
FIG. 7 is an assembled side view of FIG. 6.
Figure 8:
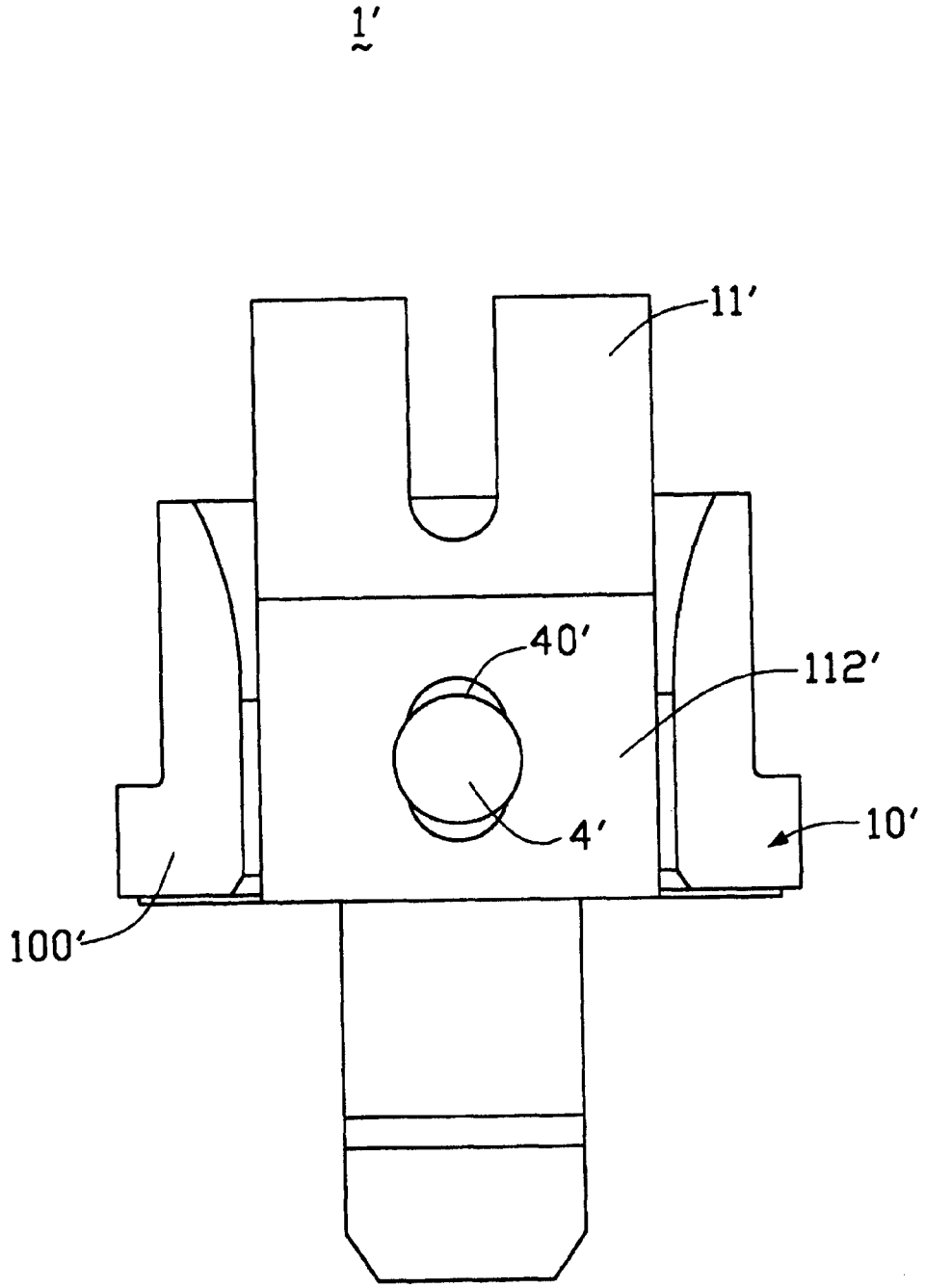
FIG. 8 is similar to FIG. 7 but viewed from a different perspective.

FIGS. 6, 7 and 8 show an EMI shield plug 1' of a second embodiment of the present invention. The differences between the two embodiments reside in the retention sections 104' of the body 10' and the engaging sections 114' of the metal plate 11'.

A pair of rods 4' projects from opposite sides of the base 100' of the body 10'. Correspondingly, a pair of elongate apertures 5' is defined in the arms 112' of the metal plate 11'. The apertures 5' are slightly larger along a vertical axis than the rods 4'. In assembly, the rods 4' are moveably received in the apertures 5' in an upward and downward direction to adjust for engagement between the enclosure 3, the metal plate 11' and the PCB 2. An engaging section 114' is inwardly bent from a distal end of each arm 112' to be attached to a bottom surface (not labeled) of the body 10'. The engaging sections 114' are wider than the arms 112' to efficiently and reliably contact with a pad (not shown) formed on the PCB 2. Ends of the rods 4' are malleable and form a larger stop portion 40' thereby preventing the disengagement of the rods 4' from the apertures 5' of the metal plate 11'.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An EMI shield plug for grounding a conductive enclosure to a PCB, comprising an insulative body including a base and a post projecting from a bottom surface of the base, the base forming a pair of retention devices on opposite sides thereof, the post being adapted to be inserted into a hole in the PCB; and a metal plate including a contact section for engaging with the conductive enclosure and a pair of arms at opposite ends of the contact section, each arm fixedly engaging with a corresponding retention device of the base of the insulative body, each arm forming an engaging section adapted for engaging with a conductive pad on the PCB proximate the hole of the PCB, each engaging section defining an arcuate cutout for extension of the post therethrough.

2. The EMI shield plug as claimed in claim 1, wherein each retention device includes a retention section and a tunnel defined through the retention section to allow extension of a corresponding arm of the metal plate therethrough thereby retaining the arm in the tunnel.

3. The EMI shield plug as claimed in claim 1, wherein the retention device includes a pair of rods and each arm defines an aperture, the rods being fixedly received in the apertures of the arms of the metal plate.

4. The EMI shield plug as claimed in claim 3, wherein each aperture is larger than the corresponding rod such that the arms of the metal plate are movable upwardly and downwardly relative to the body of the plug to adjust engagement of the enclosure, the metal plate and the PCB.

5. The EMI shield plug as claimed in claim 4, wherein ends of the rods are malleable to form a wide stop section thereby preventing the arms of the metal plate from disengaging from the rods.

6. The EMI shield plug as claimed in claim 4, wherein the engaging sections are wider than the arms to efficiently contact the pad on the PCB.

7. The EMI shield plug as claimed in claim 1, wherein an elongate slot is defined in the contact section of the metal plate to provide the contact section with resiliency.

8. The EMI shield plug as claimed in claim 1, wherein a channel is defined along a longitudinal axis of the post to provide the post with resiliency.

9. The EMI shield plug as claimed in claim 1, wherein the post includes a neck and a locking section at a distal end of the neck, the locking section being larger than the neck.

10. The EMI shield plug as claimed in claim 9, wherein the locking section defines an inclined surface for facilitating insertion of the post into the hole in the PCB.

11. The EMI shield plug as claimed in claim 1, wherein the base of the body defines a groove in a top surface thereof.

12. An EMI shield plug for grounding an enclosure of an electrical device to a grounding circuit of a printed circuit board, comprising:

a body having a base and a post extending downwardly from the base for interferingly fitting into the printed board;

a metal plate having an upper contact portion for resiliently engaging with the enclosure, an arm extending downwardly from the upper contact portion and engaging with the body, and an engaging section bent from a bottom edge of the arm and adapted for electrically engaging with the grounding circuit of the printed circuit board, the engaging section defining an arcuate cutout for extension of the post therethrough.

13. The EMI shielding plug as claimed in claim 12, wherein the engaging section of the metal plate abuts a bottom of the body.

14. An electrical assembly comprising:

a printed circuit board defining therein an opening with a pad thereabouts;

a metal enclosure positioned above said printed circuit board;

an EMI shield plug comprising:

an insulative housing including a base, and a post extending downwardly from the base and into the opening of the printed circuit board for retaining the EMI shield plug to the printed circuit board; and a metal plate attached to the housing, said metal plate including at least one engaging section sandwiched between the base and the printed circuit board, and a contact section upwardly extending from the engaging section and mechanically and electrically engaged with the enclosure, each engaging section defining an arcuate cutout for extension of the post therethrough.

15. An EMI shield plug for grounding a conductive enclosure to a PCB, comprising:

an insulative body including a base and a post projecting from a bottom surface of the base, the base forming a pair of retention devices on opposite sides thereof, each retention device comprising a retention section and a tunnel defined through the retention section, the post being adapted to be inserted into a hole in the PCB; and a metal plate including a contact section for engaging with the conductive enclosure and a pair of arms at opposite ends of the contact section, each arm being retainably inserted into a corresponding tunnel, each arm forming an engaging section adapted for engaging with a conductive pad on the PCB proximate the hole of the PCB.

* * * * *